US007069819B2

(12) United States Patent
Albertson et al.

(10) Patent No.: US 7,069,819 B2
(45) Date of Patent: Jul. 4, 2006

(54) AIR MOTOR SOCKET WRENCH WITH QUICK SOCKET RELEASE AND MUFFLER

(76) Inventors: Robert V. Albertson, 2100 Shadywood Rd., Wayzata, MN (US) 55391; David V. Albertson, 2100 Shadywood Rd., Wayzata, MN (US) 55391

( * ) Notice: Subject to any disclaimer, the term of this patent is extended or adjusted under 35 U.S.C. 154(b) by 0 days.

(21) Appl. No.: 10/970,367

(22) Filed: Oct. 21, 2004

(65) Prior Publication Data

US 2005/0087041 A1 Apr. 28, 2005

Related U.S. Application Data

(60) Provisional application No. 60/577,152, filed on Jun. 4, 2004, provisional application No. 60/514,955, filed on Oct. 28, 2003.

(51) Int. Cl.

| | |
|---|---|
| ***B25B 13/46*** | (2006.01) |
| ***B25B 17/00*** | (2006.01) |
| ***B25B 13/00*** | (2006.01) |
| ***B25B 1/00*** | (2006.01) |

(52) U.S. Cl. ..... 81/57.39; 81/59.1; 81/177.85

(58) Field of Classification Search ..... 81/57.39, 81/59.1, 177.85; 192/44, 45

See application file for complete search history.

(56) References Cited

U.S. PATENT DOCUMENTS

| | | | | |
|---|---|---|---|---|
| 1,463,497 | A * | 7/1923 | Bugatti | 81/474 |
| 2,897,932 | A * | 8/1959 | Morgan | 192/44 |
| 4,244,442 | A * | 1/1981 | Scarton et al. | 181/230 |
| 4,291,598 | A * | 9/1981 | Cherry | 81/57.15 |
| 4,603,606 | A * | 8/1986 | Headen | 81/59.1 |
| 4,669,339 | A * | 6/1987 | Cartwright | 81/59.1 |
| 4,722,252 | A | 2/1988 | Fulcher et al. | |
| 4,987,803 | A * | 1/1991 | Chern | 81/57.39 |
| 5,244,521 | A * | 9/1993 | Ligman | 156/85 |
| 6,067,881 | A * | 5/2000 | Albertson | 81/59.1 |
| 6,112,624 | A * | 9/2000 | Chen | 81/59.1 |
| 6,260,443 | B1 * | 7/2001 | Spirer | 81/57.39 |
| 6,298,753 | B1 | 10/2001 | Izumisawa | |
| 6,640,669 | B1 | 11/2003 | Izumisawa | |
| 2002/0144575 | A1 * | 10/2002 | Niven | 81/57.39 |
| 2002/0184975 | A1 | 12/2002 | Ono et al. | |
| 2003/0024715 | A1 | 2/2003 | Izumisawa | |
| 2003/0106396 | A1 * | 6/2003 | Junkers | 81/57.39 |
| 2003/0115992 | A1 | 6/2003 | Izumisawa | |

FOREIGN PATENT DOCUMENTS

FR 2227808 A * 12/1974

* cited by examiner

*Primary Examiner*—Joseph J. Hail, III
*Assistant Examiner*—Bryan Muller

(57) ABSTRACT

An air motor socket wrench has an air motor secured to a housing of a socket drive assembly having a socket drive member provided with a socket lock ball movable between a socket lock position and a socket unlock position. A hexagon body has inwardly inclined ramp sections adjacent an inside continuous cylindrical wall of a yoke drivably connected to the motor to oscillate the yoke. Rollers located between the ramp sections and cylindrical wall of the yoke transmits rotational movement of the yoke to the body and socket drive member. A muffler mounted on the air motor reduces the noise generated by the air motor.

13 Claims, 10 Drawing Sheets

AIR MOTOR SOCKET WRENCH WITH QUICK SOCKET RELEASE AND MUFFLER

CROSS REFERENCE TO RELATED APPLICATION

Applicants claim the priority benefit of U.S. Provisional Application Ser. No. 60/514,955 filed Oct. 28, 2003 and U.S. Provisional Application Ser. No. 60/577,152 filed Jun. 4, 2004.

FIELD OF THE INVENTION

The invention is in the art of power tools. The particular power tools are air motor socket wrenches having a reversible one-way drive mechanism and a releasable socket lock that maintains a socket on a socket drive member.

BACKGROUND OF THE INVENTION

Conventional socket wrenches have reversible one-way drives that include a ring of internal ratchet teeth and movable pawls that engage one or more teeth to complete the drive couple between a handle and socket drive member. Socket wrench assemblies operated with air motors have oscillating yokes having rings of internal ratchet teeth and pawls that complete the coupling of the yokes to the rotatable members joined to the socket drive members. Air motors generate high frequency noise that are detrimental to the workplace environment. The yokes must be oscillated a sufficient distance to change the interengaging positions of the ratchet teeth and pawls. The socket drive members have spring biased balls that retain the sockets on the socket drive members. In use the sockets separate from the socket drive members due to vibrations and shock forces subjected to the socket drive members and sockets. The spring biased balls do not hold the sockets on the socket drive members. The work process must be delayed to locate the separated sockets and replace the sockets on the socket drive members. This is not compatible to an efficient work process and work person stress. Examples of air motor socket wrenches are disclosed by W. A. Fulcher and G. L. Johnson in U.S. Pat. No. 4,722,252, S. Y. Chern in U.S. Pat. No. 4,987,803 and N. I. Zumisawa in U.S. Pat. Nos. 6,298,753 and 6,435,060.

SUMMARY OF THE INVENTION

The invention consists of a motor driven tool for securing and releasing fasteners, such as threaded members including nuts and bolts. The tool has a socket drive assembly mounted on an air driven motor, known as an air motor. The socket drive assembly has a socket drive member having a releasable lock ball that selectively locks a socket on the socket drive member and allows the socket to be released from the socket drive member. The socket being locked on the socket drive member during use of the tool does not separate from the socket drive member. This avoids delays in the work process to replace sockets that fall off or separate from the tools. The socket drive assembly includes a drive mechanism that does not include a ratchet mechanism for transmitting rotational force from an oscillating yoke to a body having ramps joined to the socket drive member. The drive mechanism has a plurality of rollers interposed between the ramps of the body and an inside cylindrical wall of the yoke. Each ramp has inclined ramp surfaces that move rollers into wedging engagement with the inside cylindrical surface of the yoke whereby movement of the yoke is transmitted to the body and socket drive member. The ramps and rollers being circumferentially spaced around the inside cylindrical wall of the yoke exert forces in several locations on the yoke thereby reducing stress areas, cracking and breakage of the yoke. A muffler associated with the air motor reduces the noise generated by the air motor.

The preferred embodiment of the motor driven tool is a combined air operated motor and socket drive assembly having a socket drive member provided with a releasable lock ball that selectively locks a socket on the socket drive member. The socket drive assembly includes a housing mounted on one end of the motor having laterally spaced first and second arms. Each arm has a cylindrical inside wall concentric with an inside cylindrical smooth wall of a yoke or drive member located between the arms. A body having a plurality of ramps is rotatably mounted on the first arm and a roller shifting ring member rotatably mounted on the second arm. The preferred embodiment of the tool has a body with six circumferentially spaced ramps. Each ramp has a first clockwise inwardly inclined ramp surface, a second counterclockwise inwardly inclined surface and an axial groove or slot between said first and second ramp surfaces. Each ramp surface is inclined inwardly at an angle between about 2 to about 6 degrees relative to a chord of the body. The preferred inclined angle is about 3 degrees relative to a chord on the body. Other angles can be used for the inclined ramp surfaces. The ramp surfaces are substantially flat between the axial groove which is located in the center of the ramp. Cylindrical rollers or sleeve bearings located between the ramps and inside cylindrical surface of the yoke provide reversible one-way drive couplings between the yoke and the body. Six rollers circumferentially spaced 60 degrees from each other engage separate sections of the inside cylindrical wall of the yoke. The number of ramps and rollers can vary with six rollers being preferred. The rollers subject the yoke to substantially equal forces around the yoke thereby reducing stress areas, cracking and breakage of the yoke. A roller shifting ring member or selector has arcuate segments or fingers located in the spaces between the ramps and inside cylindrical surface of the yoke and between adjacent rollers. The arcuate segments have outside surfaces spaced inwardly from the inside cylindrical surface of the yoke to allow the ring member and arcuate segments to be rotated between first and second positions relative to the body. The outer surfaces of the arcuate segments are not in frictional contact with inside cylindrical surface of yoke whereby the swinging movements of yoke do not subject the collector to friction forces that can cause the rollers to slip and disengage the yoke. Detents associated with the body and ring member selectively maintain the ring member, arcuate segments and rollers in clockwise and counterclockwise drive positions on the ramps. The roller shifting ring member and arcuate segments between adjacent rollers are manually rotated to shift the rollers between opposite ramp surfaces and maintain the rollers adjacent the selected ramp surfaces. The socket drive assembly has a shaft drivably connected to the motor whereby on operation of the motor, the shaft is rotated. Air under pressure supplied to the motor operates the motor to rotate the shaft. The shaft is joined to a crank pin supporting a bearing. The bearing is located in a pocket in the yoke whereby rotation of the shaft oscillates the yoke whereby the inside cylindrical wall of the yoke engaging the rollers on the ramp surfaces provide intermittent rotation of the body and socket drive member selectively in clockwise or counterclockwise directions. The body and socket drive member have an axial bore accommodating a push button and stem. The socket drive member has a lateral hole open to the bore. A ball located in the hole is retained by the stem in an out or lock position engageable with a socket on the socket drive member to lock the socket on the socket drive member. The socket cannot be released until the stem is moved to a position to align a pocket in the stem with the ball to allow the ball to unlock the socket whereby the socket can be removed from the socket drive member. A coil spring surrounding the stem engages the push button to bias the stem to a position to maintain the ball in the socket lock position. The air motor has a cylindrical housing surrounding an air driven rotor and a gear driven speed reducer coupled to the yoke for oscillating the yoke. The air under 90 psi flowing through the housing and discharged into the atmosphere generate a high frequency sound or squeal. An annular collar mounted on the housing has an internal chamber open to air discharge parts and an annular air discharge passage for directing air away from the work person. The collar is a muffler that deadens the sound of the air escaping from the air motor.

DESCRIPTION OF PREFERRED EMBODIMENT

Figure 1:
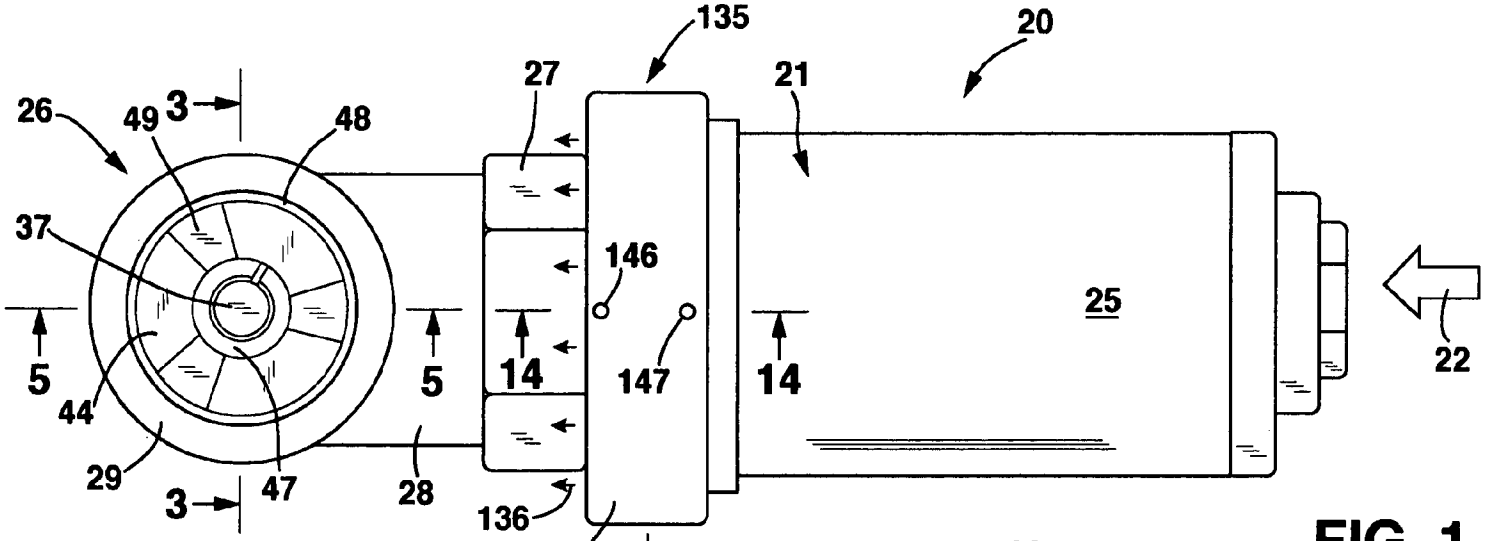
FIG. 1 is a top plan view of a combined air motor and socket drive assembly with a socket release mechanism.
Figure 2:
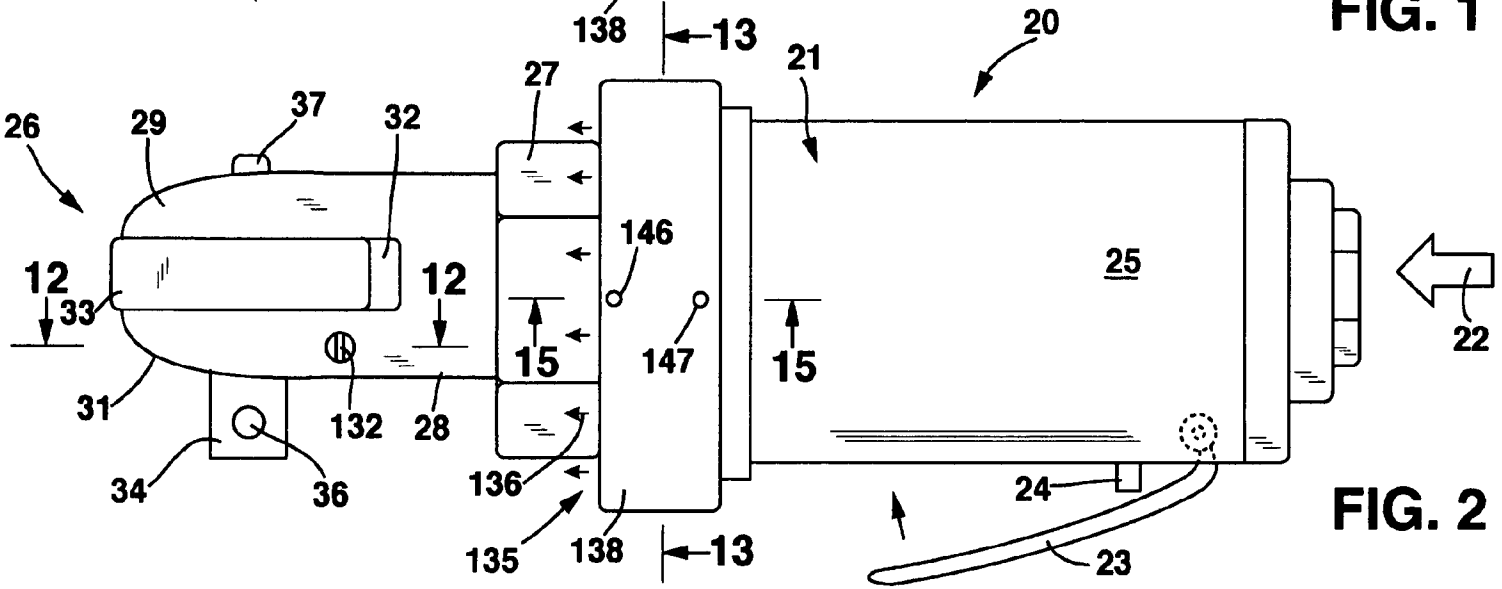
FIG. 2 is a side elevational view thereof.

An air motor socket tool 20, shown in FIGS. 1 and 2, has a generally cylindrical air-operated motor 21 adapted to be connected with a flexible hose to a source of air under pressure 22. Single stage and two-stage air compressors can be used to supply pressurized air, such as 90 psi air pressure, to run motor 21. Motor 21 has a housing 25 supporting a hand movable lever 23 operable to turn an air control valve 24 ON and OFF to regulate the flow of air into motor 21. Motor 21 is a conventional air motor of an air ratchet wrench. Ratchet wrenches having vane-type air motors are disclosed by N. Izumisawa in U.S. Pat. Nos. 6,298,753 and 6,435,060. Other types of motors, such as orbit air motors, and hydraulic and electric motors, can be used to operate the socket tool.

A socket drive assembly, indicated generally at 26, has a housing 28 secured with a nut 27 to the forward end of motor 21. Housing 28 has a bifurcated forward end comprising a top arm 29, a bottom arm 31 and a generally rectangular slot or groove 32 between arms 29 and 31. A cylindrical drive member or yoke 33 located in groove 32 has upper and lower flat surfaces slidably contacting adjacent flat surfaces of arms 29 and 31. A socket drive member 34 having a socket lock ball 36 extends downwardly from and perpendicular to arm 31. A socket lock and release mechanism has a push button 37 located adjacent the top of arm 29 is axially aligned with socket drive member 34. The details of the socket lock and release are herein described.

Figure 4:
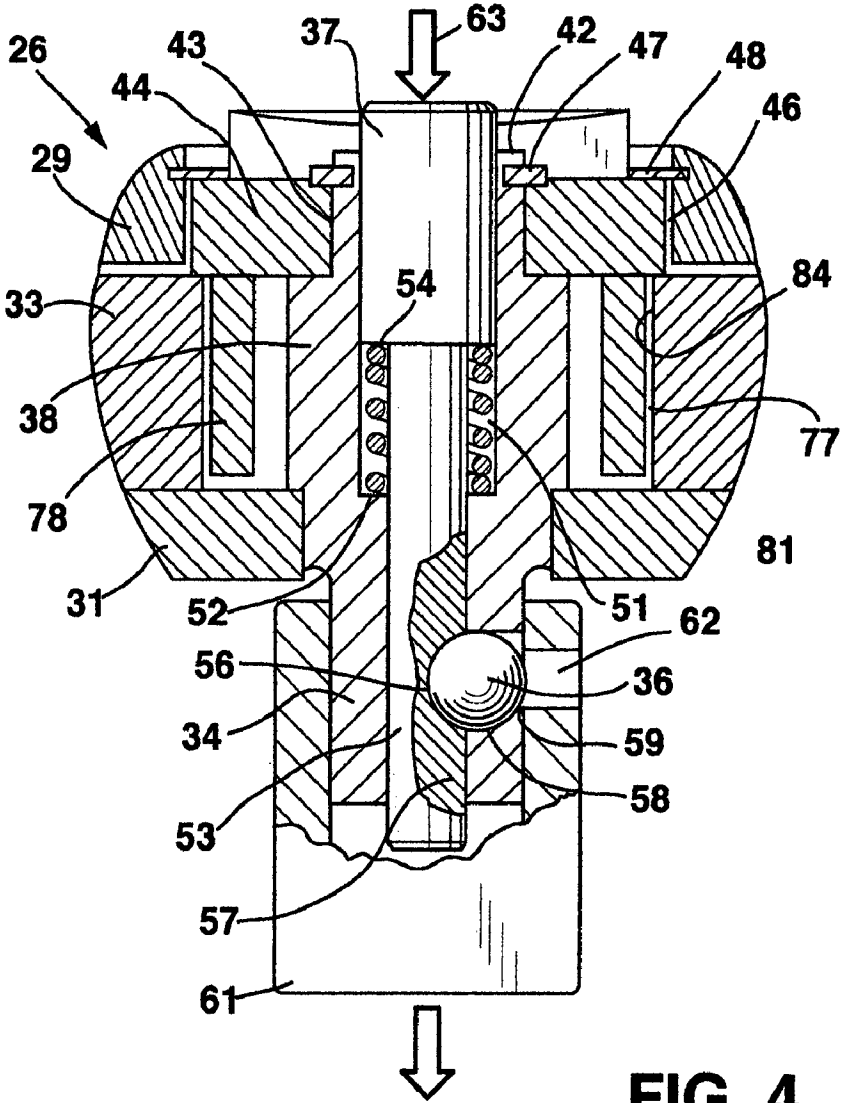
FIG. 4 is the sectional view taken along line 3—3 of FIG. 1 showing the socket in the socket release position.
Figure 3:
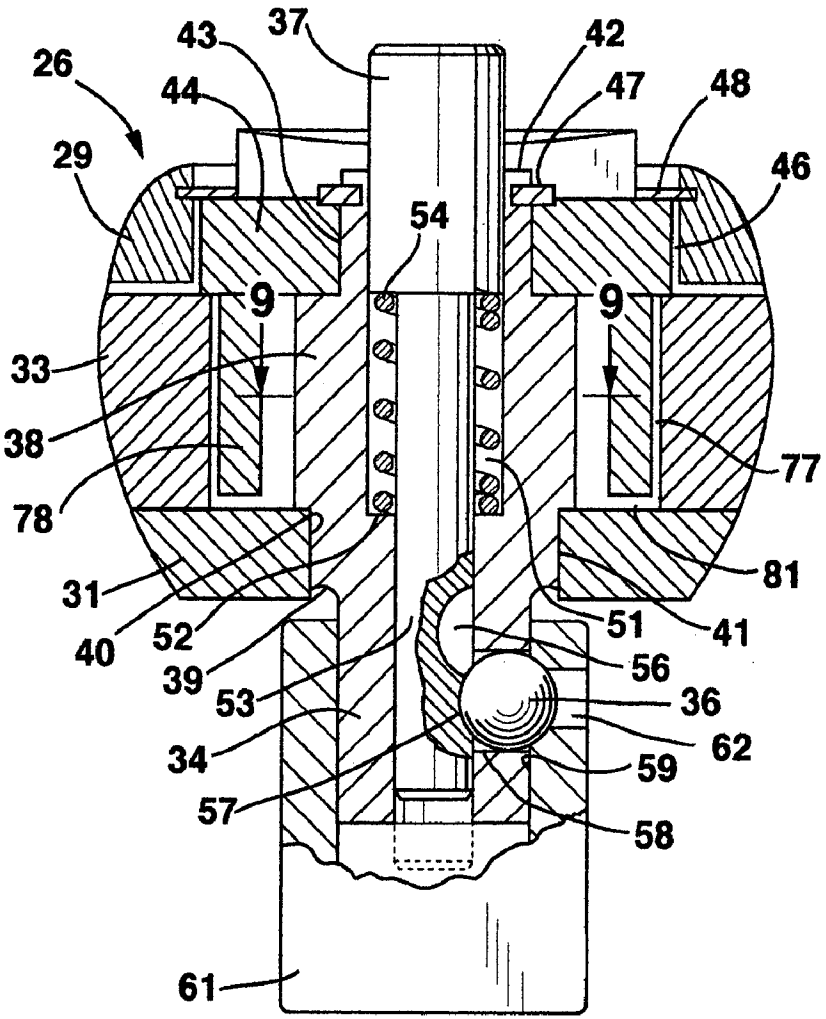
FIG. 3 is an enlarged sectional view taken along line 3—3 of FIG. 1 showing a socket in the lock-on position.
Figure 12:
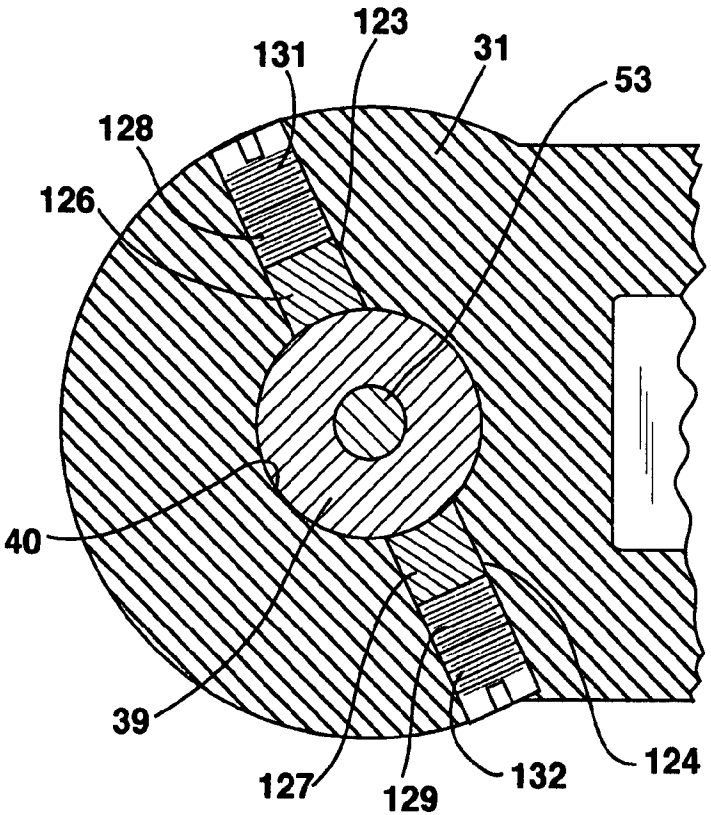
FIG. 12 is an enlarged sectional view taken along the line 12—12 of FIG. 2.

As shown in FIGS. 3 and 4, a collector or body 38 extended through yoke 33 has cylindrical lower boss 39 located in an opening in member 31. Boss 39 has an outer cylindrical surface 40 engaging a cylindrical wall 41 surrounding the opening in member 31. As shown in FIG. 12, arm 31 has a pair of bores 123 and 124 open to opposite portions of boss 39. Brake shoes or pads 126 and 127 located in bores 123 and 124 are biased with springs 128 and 129 into frictional engagement with opposite portions of surface 40 of boss 39. Pads 126 and 127 are cylindrical metal members having inner ends located in contact with surface 40. Plugs 131 and 132 threaded into bores 123 and 124 engage springs 128 and 129 and adjust the biasing force of springs 128 and 129 on the brake shoes 126 and 127. Brake shoes 126 and 127 provide a continuous drag or a brake force on boss 39 to prevent reverse rotation of body 38 during operation of the tool. The upper end of body 38 has an upright second boss 42 having an outer cylindrical surface engaging a cylindrical wall 43 of a selector or ring member 44. Ring member 44 has an outer cylindrical surface located adjacent an inside cylindrical wall 46 of arm 29. Ring member 41 has a loose fit relative to the inside wall 46 of arm 29 to allow ring member 44 and body 38 to freely rotate relative to arm 29. A split washer 47 positioned in an annular groove in boss 42 contacts the top of ring member 44 to maintain ring member 44 around boss 42. A second split washer or ring 48 located in an annular groove in arm 29 engages an outer annular section of the top of ring member 44 to retain ring member 44 on arm 29. As shown in FIG. 1, ring member 44 has three circumferentially spaced knobs 49 used by the workperson to facilitate manual rotation of ring member 44 to selectively index ring member 44 for clockwise and counterclockwise operation of socket drive assembly 26.

Returning to FIGS. 3 and 4, body 38 has an axial cylindrical bore 51 with a central inwardly directed step 52. Socket release push button 37 partly located in bore 51 above step 52 is joined to a cylindrical stem 53 extended through bore 51. Stem 53 is in sliding contact with the cylindrical wall of bore 51 below step 52. A coil spring 54 surrounding stem 53 has an upper end engaging button 37 and a lower end engaging step 52. Spring 54 biases stem 53 in an upward direction and retains socket lock ball 36 in socket lock position shown in FIG. 3. A side of stem 53 has a semi-cylindrical recess or pocket 56 and a groove 57 extended downwardly from pocket 56. Socket lock ball 36 is positioned in a lateral hole 58 in socket drive member 34. Hole 58 is aligned with pocket 56 and groove 57. The annular portion of member 34 surrounding the outer end of hole 58 has an inwardly directed lip 59 having a diameter smaller than the diameter of ball 36 to prevent ball 36 from falling out of hole 58. As shown in FIGS. 3 and 4, a conventional socket 61 has a square hole at one end thereof which accommodates square socket drive member 34. The side wall of socket 61 has a hole 62 aligned with ball 36. Alternative sockets have inside recesses and grooves for socket retaining balls. As shown in FIG. 3, when stem 53 is in the up or lock position, ball 36 in groove 57 is retained in an inside portion of hole 62 whereby socket 61 is locked on socket drive member 34. Vibrations and forces applied to socket 61 do not release socket 61 from socket drive member 34. As shown in FIG. 4, when socket release button 37 is moved down or depressed, as shown by arrow 63, pocket 56 is aligned with ball 36. Ball 36 is free to move into pocket 56 and out of hole 62 of socket 61. When ball 36 is in pocket 56, socket 61 can be manually removed axially from socket drive member 34.

Figure 6:
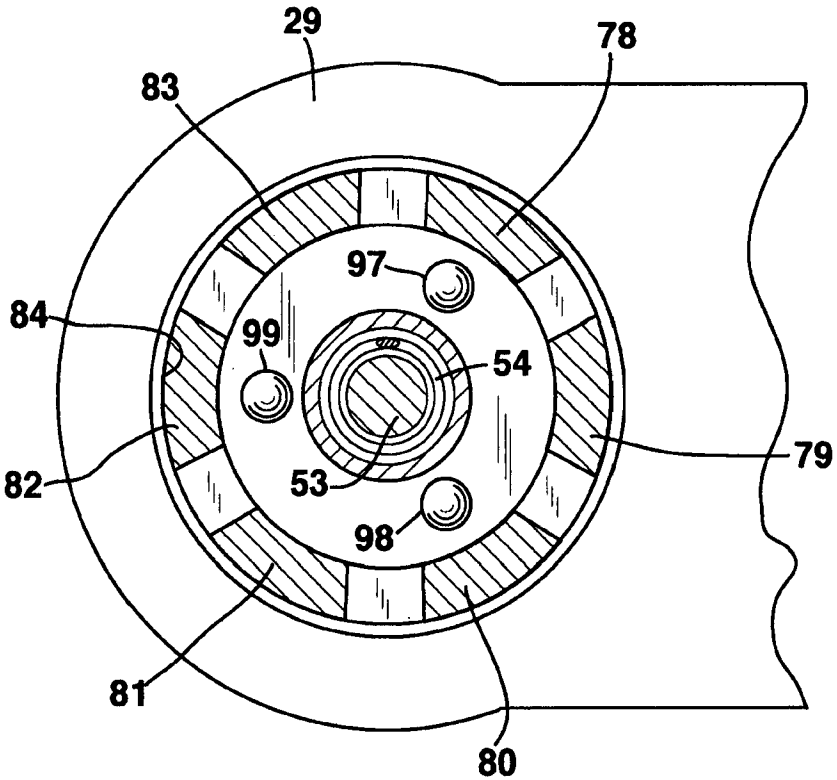
FIG. 6 is a sectional view taken along line 6—6 of FIG. 5.
Figures 7, 8:
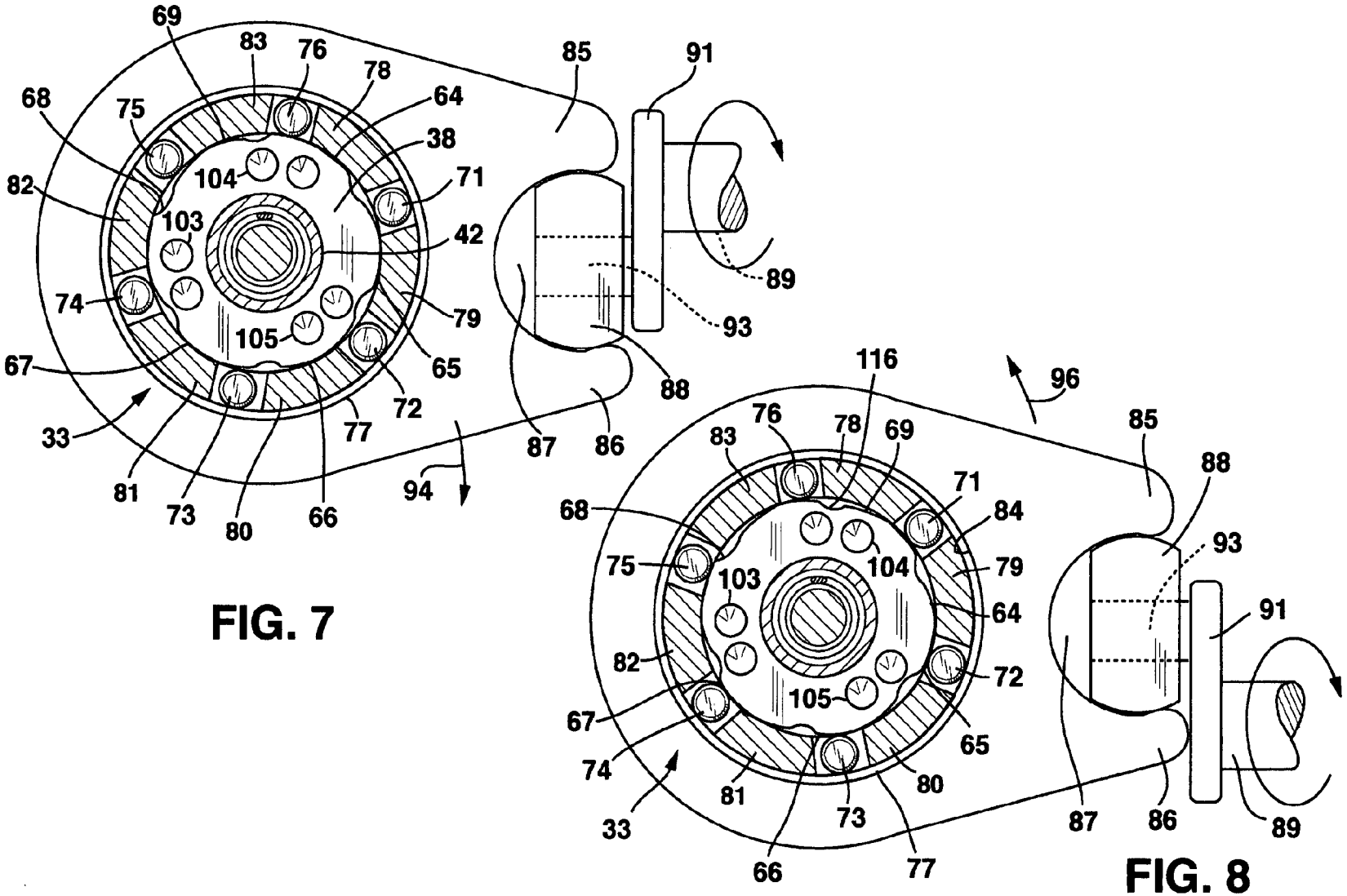
FIG. 7 is a sectional view taken along line 7—7 of FIG. 5 showing the rollers in the clockwise drive position.
FIG. 8 is the sectional view taken along line 7—7 of FIG. 5 showing the rollers in the counterclockwise drive position.

A ratchet-less drive member, shown in FIGS. 7 and 8, transmits oscillating or swinging movements of yoke 33, indicated by arrows 94 and 96, into rotary movements of body 38 thereby turning socket drive member 34 and socket 61 thereon. Body 38 has an outer generally hexagonal peripheral surface divided into six inclined ramps 64–69. Each ramp 64 to 69 has substantially the same profile shown in particular in FIGS. 9 and 10. A cylindrical roller 71–76 is located between each ramp 64–69 and an inside cylindrical wall 77 of yoke 33. Wall 77 has a continuous smooth cylindrical inside surface. Rollers 71–76 are hard metal cylindrical members having longitudinal axes parallel to the axis of cylindrical wall 77 and the longitudinal axis of rotation of body 38. Rollers 71–76 concurrently contact circumferentially spaced areas of yoke 33 to distribute substantially equal forces around circumferentially spaced portions of the yoke 33 to reduce cracking and breaking of rollers 71–76 and yoke 33. Adjacent rollers are circumferentially spaced from each other about 60 degrees. A chord line between the axes of adjacent rollers is equal to a radial line between the axis of body 38 and the axis of each adjacent roller. These lines are an equilateral triangle. This arrangement of rollers 71–76 provides maximum strength of yoke 33 and body 38. Arcuate members or fingers 78–83 are located between adjacent rollers 71–76. Members 78–83, as shown in FIGS. 3, 4 and 11, are joined to ring member 44 and project downwardly into the opening in yoke 33. Each member 78–83 has an arcuate outside surface 84 spaced inwardly from the inside cylindrical wall 77 of yoke 33. As shown in FIGS. 7 and 8, the outside arcuate surface 84 of each member 78–83 is not in frictional contact with wall 77 of yoke 33. The spaced relationship between the surfaces 84 and 77 does not subject collector 44 to friction forces during swinging movements of yoke 33 that can cause one or more rollers 78–83 to slip and disengage wall 77 of yoke 33. The lower ends of members 78–83 are spaced above arm 31 to eliminate frictional contact between members 78–83 and arm 31. As seen in FIGS. 6, 7 and 8, radial ends of adjacent members 78–83 are circumferentially spaced from each other to accommodate rollers 71–76 and allow each roller 71–76 to rotate and radially move between its respective ramp 64–69 and cylindrical wall 77 of yoke 33. The circumferential distance between the ends of adjacent members is greater than the diameter of rollers 71–76 to allow rollers 71–76 to wedge between wall 77 of yoke 33 and ramps 64–69 when yoke 33 is moved in one direction and to allow rollers 71–76 to disengage wall 77 when yoke 33 is moved in a direction opposite the one direction. Members 78–83 retain the rotational axis of rollers 71–76 substantially parallel to cylindrical wall 77 and the rotational axis of body 38.

Figure 10:
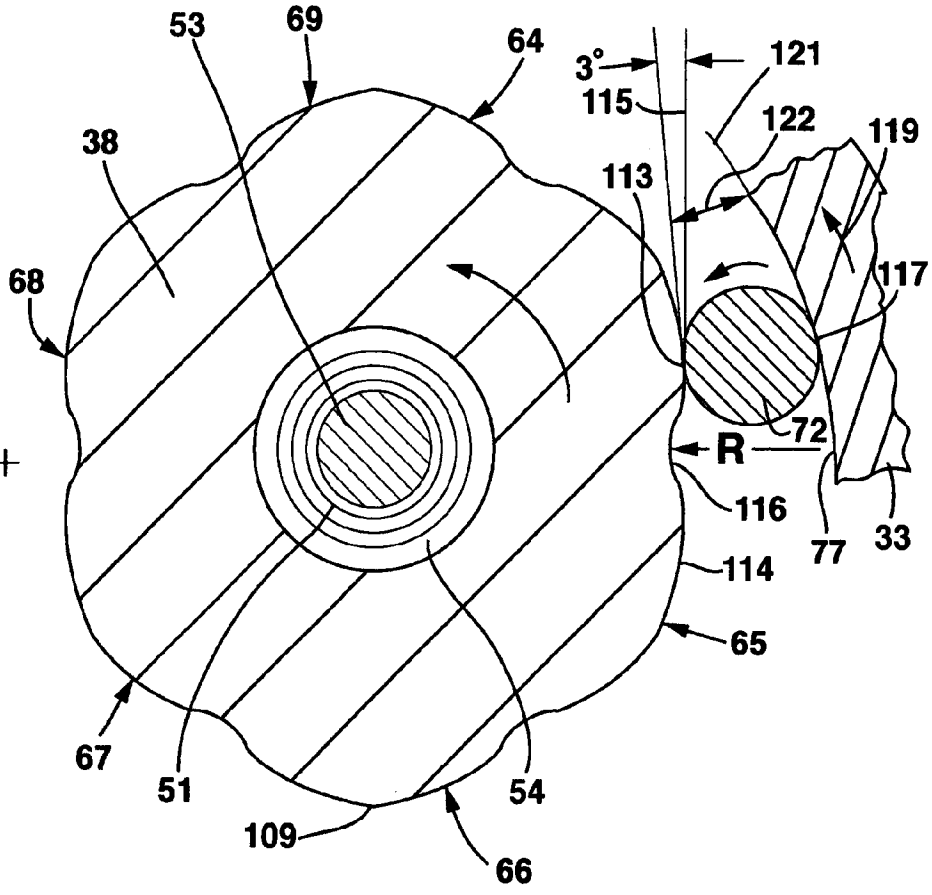
FIG. 10 is a sectional view similar to FIG. 9 showing a roller in driving engagement with the yoke and body.
Figure 9:
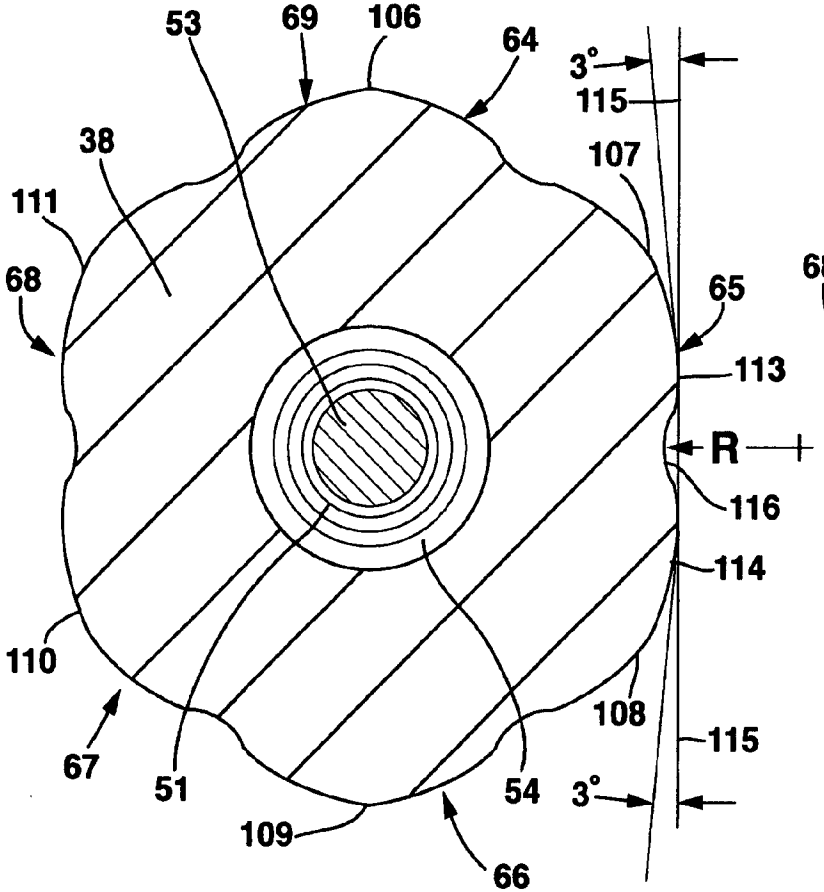
FIG. 9 is an enlarged sectional view taken along line 9—9 of FIG. 3.
Figure 11:
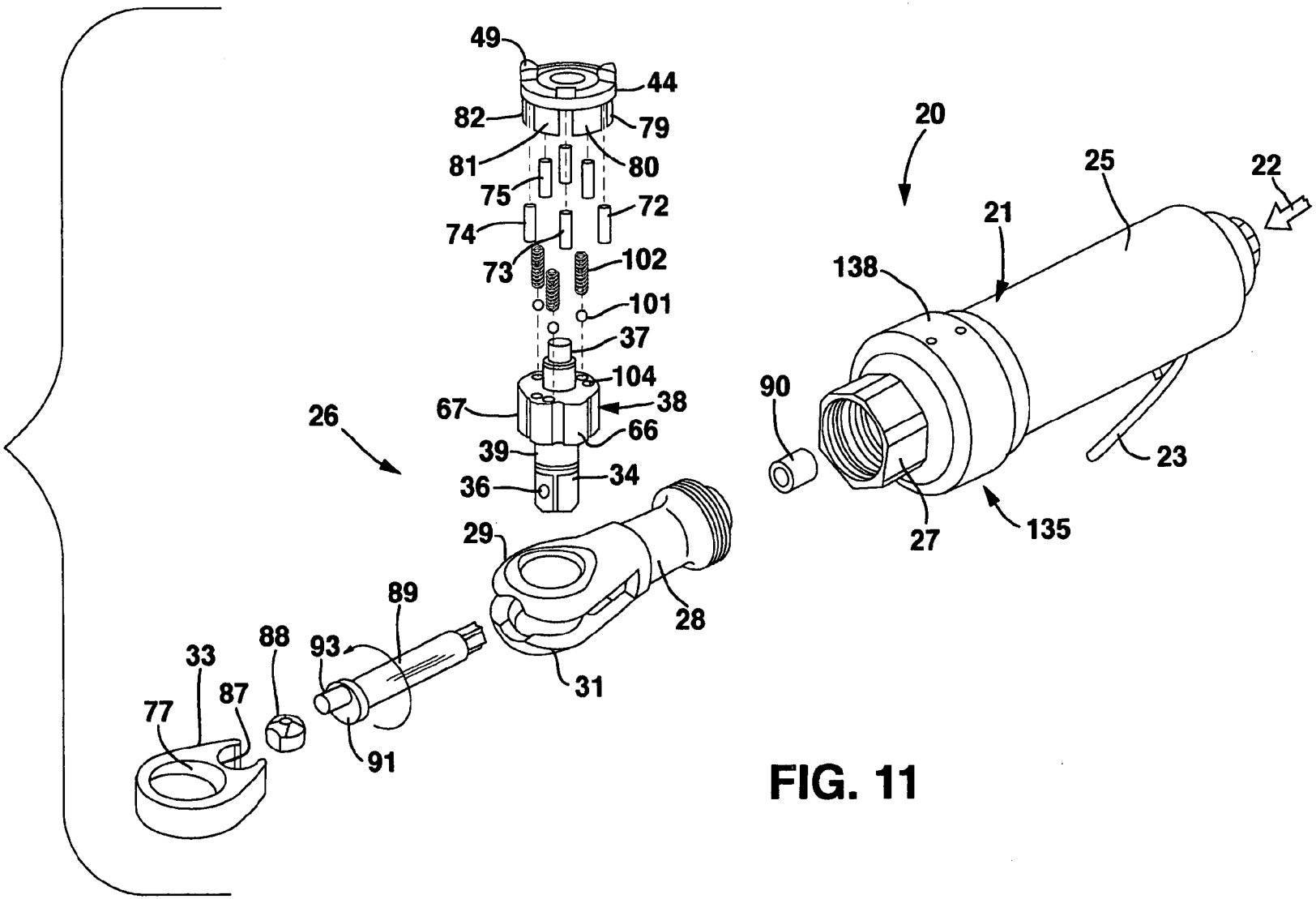
FIG. 11 is an exploded perspective view of the air motor and socket drive assembly of FIG. 1

An enlarged cross sectional view of the body 38, illustrated in FIGS. 9 and 10, shows the profiles of ramps 64–69 and bore 51 accommodating stem 53 and coil spring 54. Each ramp 64–69 has a 60 degree arcuate segment of the circumference of the external boundary or periphery of body 38. Crowns or convex sections 106, 107, 108, 109, 110 and 111 join adjacent ramps. Ramps 64–69 have substantially the same structure and profiles. The following description of ramp 65 is applicable to ramps 64 and 66–69. Ramp 65 has a clockwise inwardly inclined first surface 113 and a counterclockwise inwardly inclined second surface 114. Surfaces 113 and 114 are substantially flat and converge from adjacent crowns 107 and 108 to the middle section of ramp 65. Surfaces 113 and 114 can have a slight convex shape. A concave groove or recess 116 is located in the middle section of ramp 65 between the surfaces 113 and 114. Recess extends parallel to the axis of rotation of body 38. Recess 116 is an arcuate segment of a circle having a radius R generally equal to the diameter of roller 72. The recess can be U-shaped or a notch. The recess 116 provides a space for roller 72 in the middle of ramp 65 to allow roller 72 to retract inwardly away from wall 77 of yoke 33 and prevent the roller 72 from shifting beyond the center of ramp 65 to the opposite drive position. Ramp surface 113 is inclined inwardly in a counterclockwise direction at an angle of about 3 degrees relative to a chord plane 115. Ramp surface 114 is inclined inwardly in a clockwise direction at an angle of about 3 degrees relative to chord plane 115. Inclined angles between about 2 to about 6 degrees of ramp surfaces 113 and 114 may be used. As shown in FIG. 10, roller 72 is wedged between surface 113 of body 38 and cylindrical wall 77 of yoke 33 when yoke 33 is turned in the counterclockwise direction, shown by arrow 119. Roller 72 in contact with wall 77 of yoke 33 is rotated in a counterclockwise direction due to movement of yoke 33 and rides up surface 113 thereby increasing the gripping forces of roller 72 on wall 77 and 113. Roller 72 is in frictional wedging contact in area 117 of wall 77 and frictional wedging contact with a portion of surface 113 of ramp 65. The contact areas of roller 72 on wall 77 and surface 113 is slightly less than 180 degrees when viewed in a clockwise direction. A tangent line 121 extended through area 117 converges with the plane of surface 113. The angle 122 between tangent line 121 and the plane of surface 113 is an acute angle. Angle 122 is greater than the angle between tangent line 121 and the plane of chord 115. The greater acute angle 122 enhances the grip between roller 72 and wall 77 and surface 113. When yoke 33 is turned in a clockwise direction roller 72 rides up inclined ramp surface 114 and wedges between wall 77 and surface 114 of ramp 65.

Figure 5:
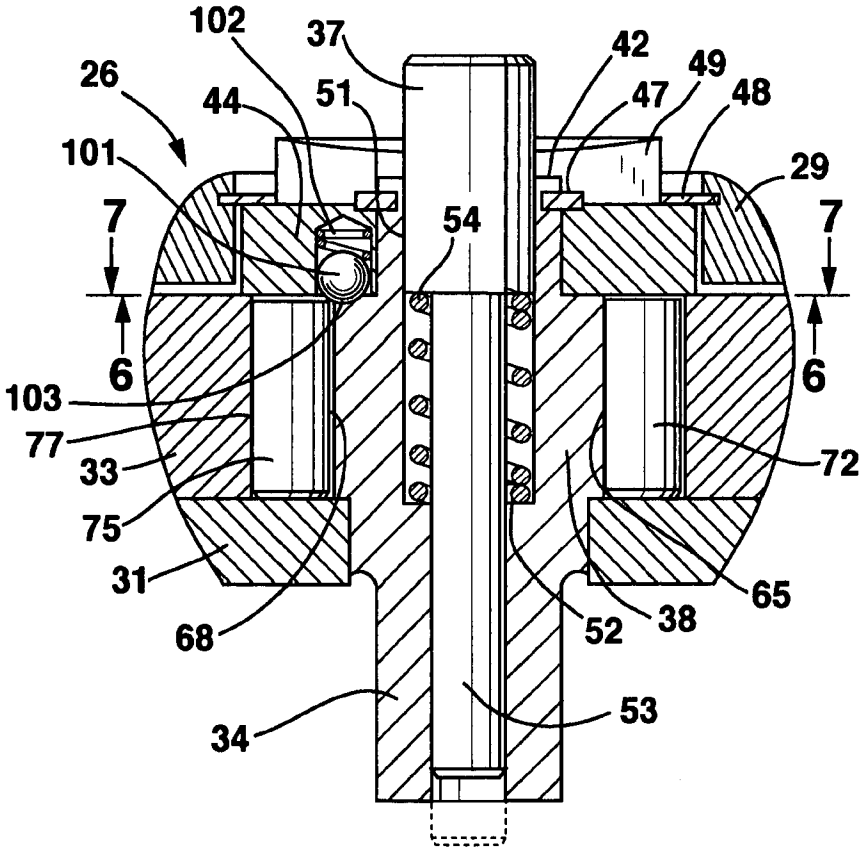
FIG. 5 is an enlarged sectional view taken along line 5—5 of FIG. 1.

As shown in FIGS. 5 and 6, three releasable holders or detents 97, 98 and 99 mounted on ring member 44 operate to selectively hold ring member 44 in first and second positions relative to body 38. Each detent comprises a ball 101 and spring 102 located in a blind bore in ring member 44. Cylindrical members can be used in lieu of balls for detents 97–99. Ball 101 biased downwardly by spring 102 into a recess 103 in the top of body 38 retains ring member 44 in a selected position. As shown in FIGS. 7 and 8, the top of body 38 has three pairs of recesses 103, 104 and 105 circumferentially spaced around body 38. The pairs of recesses 103–105 determine the first and second positions of ring member 44. When ring member 44 is in the first position arcuate members 78–83 locate rollers 71–76 adjacent one end of ramps 64–69 as shown in FIG. 7. When ring member 44 is moved to the second position arcuate members 78–83 locate rollers 71–76 adjacent the other end of ramps 64–69, as shown in FIG. 8.

Figure 13:
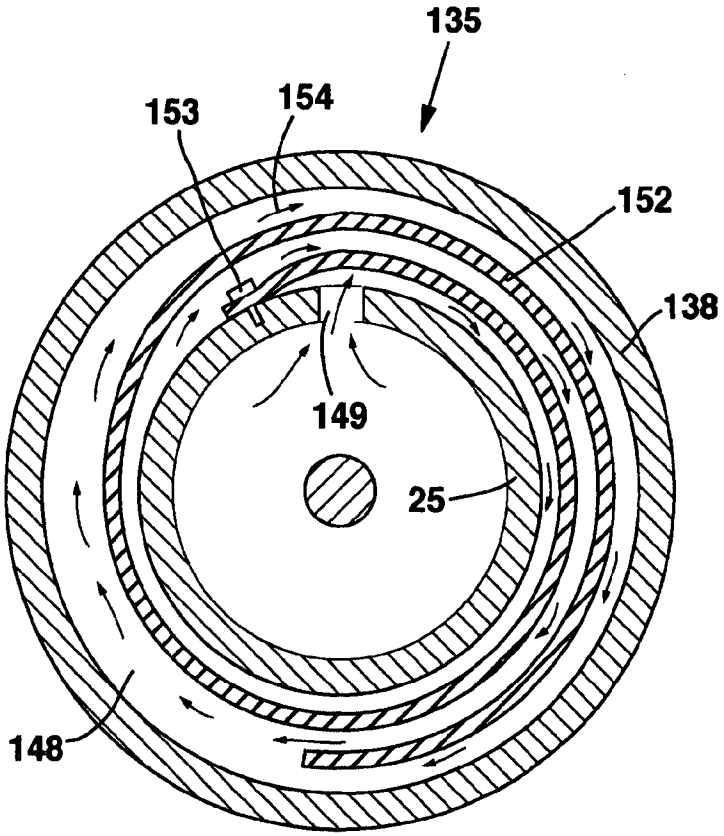
FIG. 13 is an enlarged sectional view taken along the line 13—13 of FIG. 2.
Figure 15:
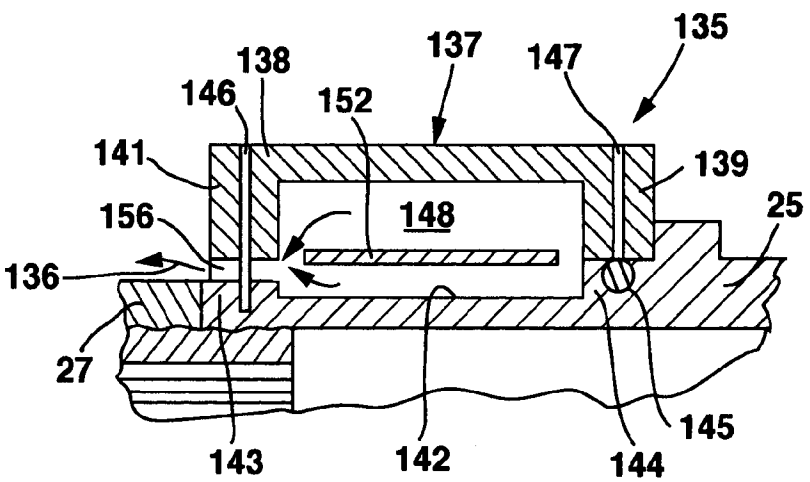
FIG. 15 is an enlarged sectional view taken along the line 15—15 of FIG. 2.
Figure 14:
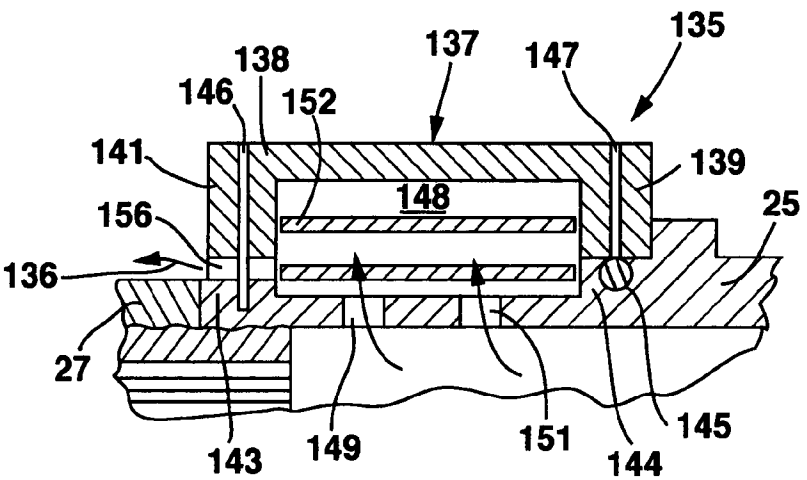
FIG. 14 is an enlarged sectional view taken along the line 14—14 of FIG 1.

As shown in FIGS. 1 and 2, a sound attenuator or muffler, indicated generally at 135, surrounds and is mounted on the forward end of housing 25. Air, shown by arrows 136, is discharged from muffler 135 in a forward direction in a cylindrical path around nut 27 away from the work person's hand gripping housing 25. Flowing air does not interfere with the hand operation of tool 20. Muffler 135, shown in FIGS. 13, 14 and 15, has an annular collar 137 having a cylindrical sleeve 138 jointed to circular end members 139 and 141. Collar 137 telescope over housing 25 over annular recess 142 with end member 139 located on wall 144 in sealing contact with an O-ring 145 and end member 141 spaced above rib 143. Fasteners 146 and 147, shown as threaded bolts, secure collar 137 to housing 25 to enclose an anti-resonant chamber 148. As shown in FIG. 14, housing 25 has a plurality of openings or ports 149 and 151 to allow air to flow from the air motor located in housing 25 into anti-resonant chamber 148. The air motor and air flowing through air motor and into anti-resonant chamber 148 generates audible sounds with audible frequencies in the range of 10,000 to 20,000 hertz or more. These sounds are environmentally objectionable to the work person. Muffler 135 attenuates these sounds to levels compatible to the work person's environment. A helical member 152 having a rectangular cross section is located within anti-resonant chamber 148. Fasteners 153, shown as a bolts in FIG. 13, connect the inner end of helical member to housing 25 adjacent openings 149 and 151. Helical member 152 is a metal spring band with overlapped sections that direct air from ports 149 and 151 into a helical path, shown by arrows 154 in FIG. 13. The metal spring band and helical flow of the air mitigates sound waves thereby muffling sound. As shown in FIGS. 14 and 15, air flows from anti-resonant chamber 148 to atmosphere through an annular passage 156. The exit air flow pattern is a continuous generally cylindrical sleeve which produces only low noise or audible sounds.

Figure 16:
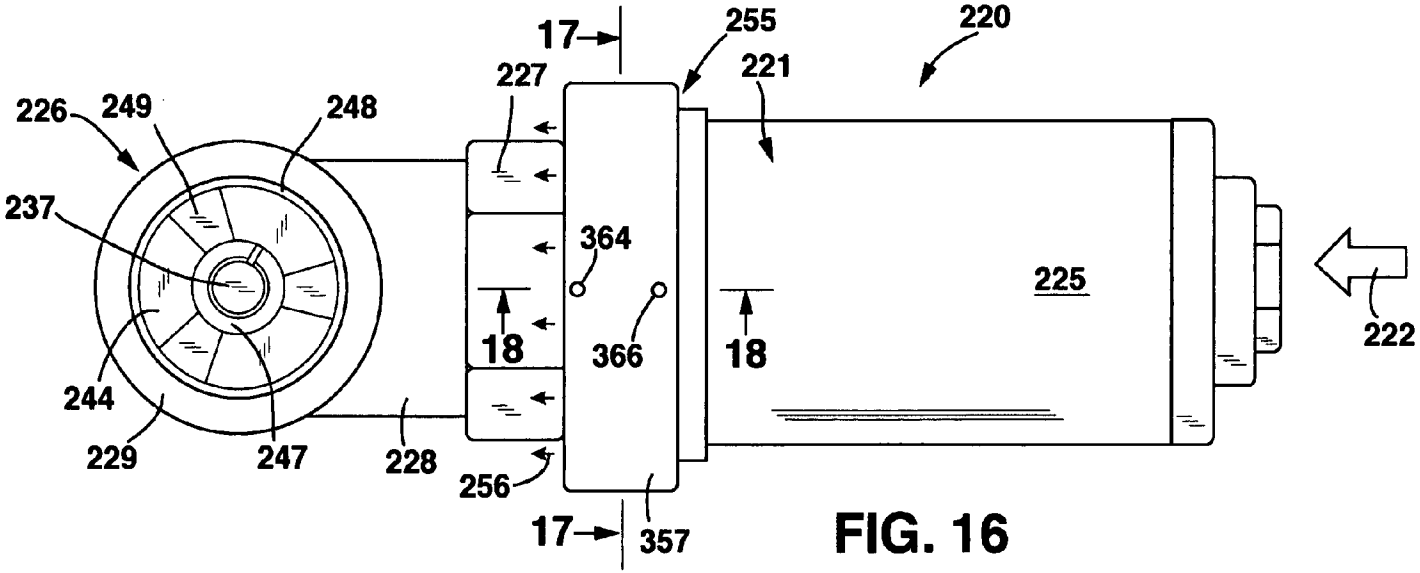
FIG. 16 is a top plan view of a first modification of the air motor socket wrench of FIG. 1.
Figure 18:
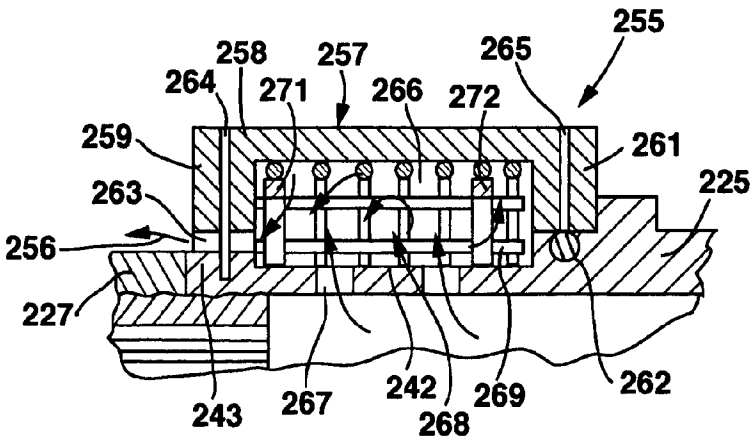
FIG. 18 is an enlarged sectional view taken along the line 18—18 of FIG. 17.
Figure 17:
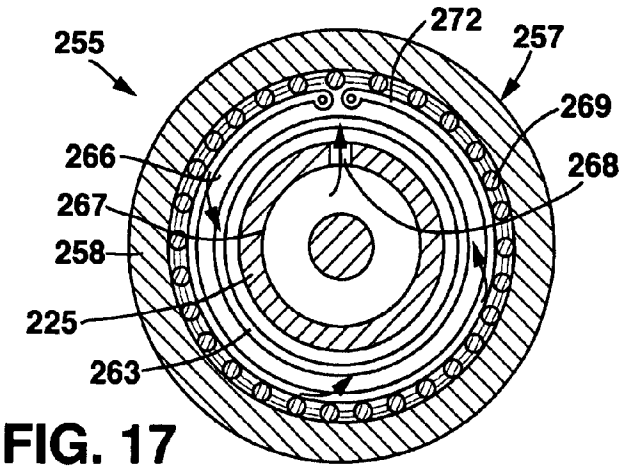
FIG. 17 is an enlarged sectional view taken along the line 17—17 of FIG. 16.

A first embodiment of a muffler 255 mounted on the housing of an air motor socket wrench is shown in FIGS. 16 to 18. The parts of the air motor and socket drive assembly of FIGS. 16 to 18 have the same reference numbers with a prefix 2 as the same parts of the air motor 21 and socket drive assembly 26 shown in FIGS. 1 and 2. A sound attenuator or muffler, indicated generally at 244, surrounds and is mounted on the forward end of air motor housing 225. Air, shown by arrows 256 from muffler 255 flows in a generally cylindrical path around nut 227 away from the workperson holding air motor housing 225. As shown in FIGS. 17 and 18, muffler 256 has an annular collar 257 having a cylindrical sleeve 258 joined to inwardly extended circular end members 259 and 251. Collar 257 telescopes onto the forward end of housing 225 over annular recess 252 with end member 261 in sealing contact with an O-ring 252 and end member 249 spaced above rib 243 to provide an annular air exit passage 253. Fasteners 254 and 254, shown as threaded bolts, secure collar 257 to housing 225 to enclose an anti-resonant chamber 255. Housing 225 as shown in FIG. 18 has a plurality of ports 267 and 268 open to chamber 266 to allow air to flow from the air motor located in housing 225 into anti-resonant chamber 266. A cylindrical wire screen 269 is located in chamber 266 adjacent the inside wall of sleeve 258. A pair of expansion rings 271 and 272 retain screen 269 in engagement with sleeve 258. The air flowing into anti-resonant chamber 266 contacts screen 269 and mitigates sound waves thereby muffling sound. The air flows from anti-resonant chamber 266 through annular passage 264 to atmosphere. The exit air flow pattern is a continuous generally cylindrical sleeve which produces only low noise or audible sounds.

Figure 19:
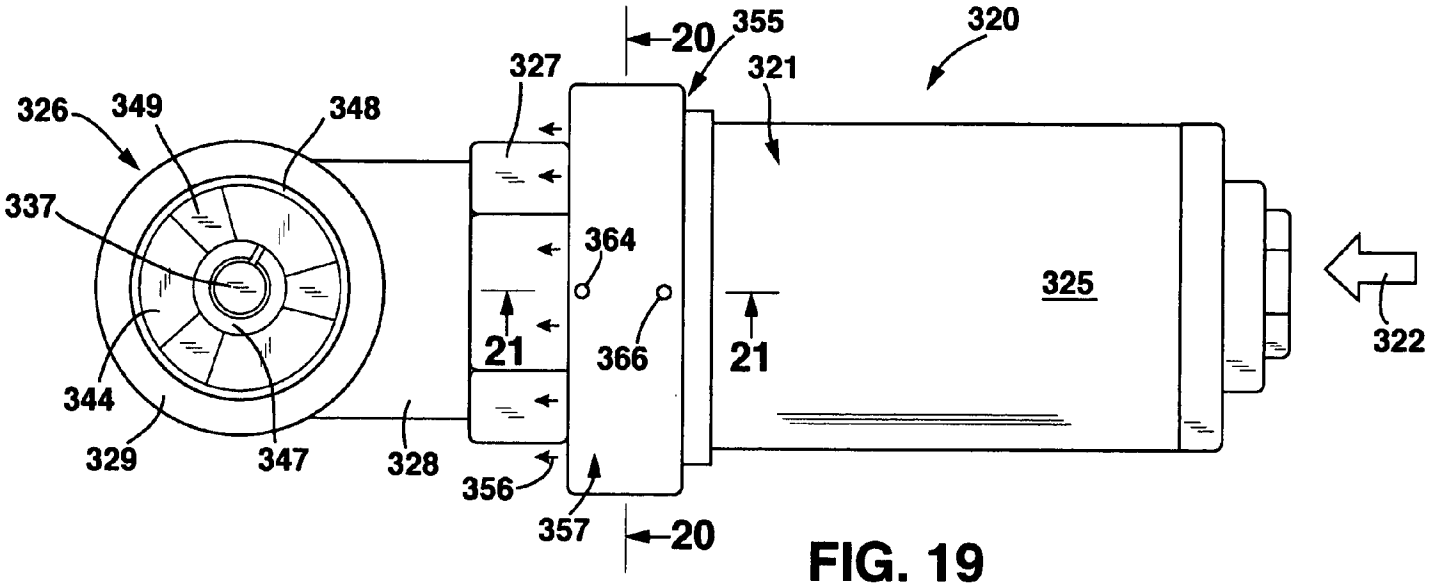
FIG. 19 is a top plan view of a second modification of the air motor socket wrench of FIG. 1.
Figure 21:
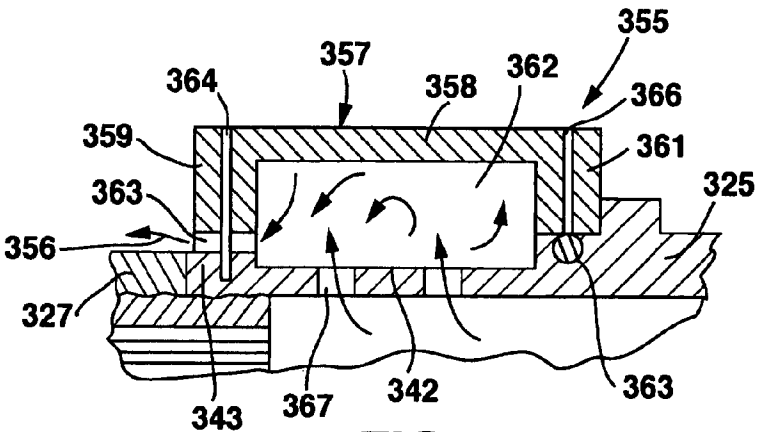
FIG. 21 is a sectional view taken along line 21—21 of FIG. 19.
Figure 20:
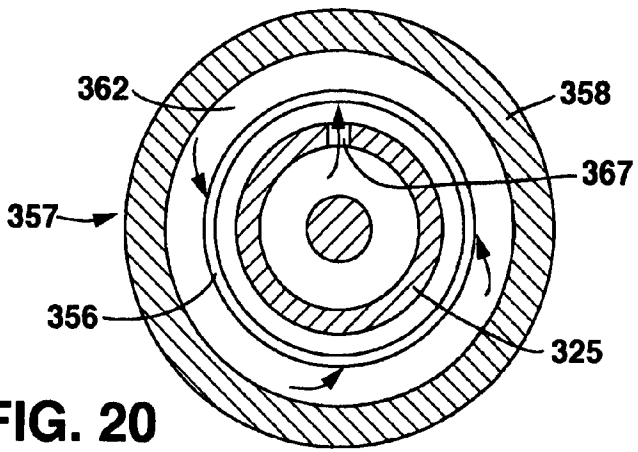
FIG. 20 is a sectional view taken along line 20—20 of FIG. 19.

A second embodiment of a muffler 355 mounted on a housing of an air motor socket wrench is shown in FIGS. 19 to 21. The parts of the air motor socket wrench shown in FIGS. 19 to 21 have the same reference numbers with a prefix 3 as the parts of the air motor 21 and socket drive assembly 26 shown in FIGS. 1 and 2. A sound attenuator or muffler 355 is located around and mounted on the forward end of air motor housing 325. Air, shown by arrows 356, flows forward from muffler 355 in a generally cylindrical path around nut 327 to atmosphere. The discharge air flows away from the workperson holding air motor housing 325. As shown in FIGS. 20 and 21, muffler 355 has an annular collar 357 comprising a cylindrical sleeve 358 joined to inwardly extended circular end members or walls 359 and 361. Collar 357 telescopes onto the forward end of housing 325 and forms with housing 325 an anti-resonant chamber 361. Chamber 361 is a torus space in communication with air ports 367 which allow air from the air motor to flow into chamber 362. End member 361 is located in sealing contact with an O-ring 363 located in a groove in housing 325. End member 359 is spaced above rib 343 providing an annular air exit passage 363 for directing air away from muffler 355. Fasteners 364 and 366, shown as bolts, secure collar 357 to housing 325. Other types of structure, including threads can be used to mount collar 357 on housing 325. Air flowing through ports 367 into chamber 362 expands and moves in a circular path around the cylindrical inside wall of sleeve 358. The sound waves of the expanding and flowing air are attenuated and mitigated thereby reducing the frequency and intensity of the sound generated by the air motor. The reduction of noise from the air wrench tool is environmentally compatible with the workplace.

Mufflers 135, 255 and 355 are mounted on air motor housings connected to socket drive assemblies housing roller drives or non-ratchet drives. Mufflers 135, 255 and 355 can be mounted on conventional air motors to mitigate the sounds generated by these motors. These air motors can operate ratchet socket assemblies and longitudinal drives for drills and screwdrivers.

As shown in FIG. 11, air motor 21 operates to rotate shaft 89. Conventional air motors have rotors and air regulators operable to control air flow and pressure to the rotors. Gear trains, such as planetary gear train and other types of power transmission, connect the rotors to shafts to transmit power from the rotors to the shafts. Examples of air motors for socket wrenches are disclosed by N. Izumisawa in U.S. Pat. Nos. 6,298,753 and 6,435,060. The muffler 135 around the air motor housing 25 has an anti-resonant chamber 148 and an annular air discharge opening that directs air away from the workperson. Shaft 89 turns drive bearing 88 in a circular path about the axis of shaft 89. Drive bearing 88 being located in pocket 87 of yoke 33 oscillates yoke 33 about an axis normal to the longitudinal axis of shaft 89 shown by arrows 94 and 96 in FIGS. 7 and 8. The oscillating yoke 33 through rollers 71–76 rotates body 38 thereby turning socket drive member 34 and socket 61 locked thereon. As shown in FIG. 3, stem 53 holds ball 36 in the socket lock position which prevents socket 61 from being removed from socket drive member 34. Socket release button 37 must be pushed into body 38 to release ball 36 to allow socket 61 to be removed from socket drive member 34.

The invention has been disclosed with reference to a several embodiments of an air motor socket tool having a socket lock and release and muffler. Variations and modifications of structures, arrangement of structures and materials can be made by a person skilled in the art without departing from the invention. The following claims are intended to cover each such variation and modification that are within the scope of the invention.

The invention claimed is:

1. A power operated tool for holding and turning a socket comprising: a motor, a socket drive assembly having a housing secured to said motor, said housing having a first arm and a second arm laterally spaced from the first arm, each arm having an inside cylindrical wall, a yoke located between said arms, said yoke having a continuous smooth inside cylindrical wall concentric with the cylindrical walls of the arms, a rotatable body having a plurality of ramps extended through said yoke with the ramps facing the cylindrical wall of the yoke and a socket drive member adapted to hold a socket, each of said ramps having a clockwise inwardly inclined ramp surface, a counterclockwise inwardly inclined ramp surface and a recess between said ramp surfaces for positioning a roller inwardly of the cylindrical surface of the yoke, said body and socket drive member having an axial bore, a stem movably located in said bore for movement between first and second positions, an opening in said socket drive member, a ball located in said opening movable between a socket lock position and a socket release position, said stem having a pocket aligned with the opening to allow the ball to move into the pocket to the socket release position and an axial groove open to the socket to retain the ball in the socket lock position thereby preventing the socket from being removed from the socket drive member, and biasing means for biasing the stem to the first position wherein the ball is in the socket lock position, said stem being movable from the first position to the second position wherein the ball is located in said pocket and socket release position, a plurality of rollers located between and engagable with said inclined ramp surfaces and the cylindrical wall of the yoke operable to transmit rotational force from the yoke to the body and socket drive member, a ring member rotatably mounted on an arm and body for arcuate movement between first and second positions, arcuate segments secured to the ring member spaced inwardly from the cylindrical wall of the yoke and between adjacent rollers for moving the rollers in response to rotation of the ring member adjacent opposite inwardly inclined ramp surfaces, detents mounted on the ring member and engagable with recesses in the body to selectively retain the ring member in the first and second positions, a shaft rotatably mounted on the housing operably connected to said motor whereby the motor operates to rotate the shaft, a drive connection coupling the shaft to the yoke for oscillating the yoke in response to rotation of the shaft, said oscillation of the yoke moves the rollers into driving wedging engagement with the outwardly inclined ramp surfaces and cylindrical wall of the yoke whereby rotational movement of the yoke is transmitted through the rollers to the body, socket drive member and socket locked onto the socket drive member, a brake mounted on one of said arms of the housing and engageable with the body for applying a continuous drag on the body, said motor being a noise generating air operated motor having a motor housing with at least one air discharge port, and a muffler for reducing the noise generated by the operation of the motor, said muffler being mounted on the motor housing and having a chamber for receiving air from the air discharge port and an air exit opening allowing air in the chamber to flow from the chamber to atmosphere, said muffler having an annular collar surrounding a section of the motor housing that includes the air discharge port, said collar enclosing said chamber, an end wall joined to the collar spaced from the motor housing producing an annular air exit opening to allow air to flow out of the chamber to atmosphere, and a fastener for attaching the collar to the air motor housing.

2. The tool of claim 1 wherein: the motor is operated with air above atmospheric pressure.

3. The tool of claim 1 wherein: the arms have facing flat surfaces, and the yoke has flat surfaces located in sliding engagement with flat surfaces of the arms.

4. The tool of claim 1 wherein: the body has a hexagonal shape with six ramps located around the periphery of the body, and said rollers comprising six cylindrical rollers engagable with said ramp surfaces.

5. The tool of claim 4 wherein: adjacent rollers are circumferentially spaced about 60 degrees from each other.

6. The tool of claim 4 wherein: each of the ramp surfaces is inclined inwardly at an angle between about 2 to about 6 degrees relative to a chord plane of the body.

7. The tool of claim 1 wherein: said body has a first boss rotatably mounted on the cylindrical wall of the second arm and a second boss, said ring member being rotatably mounted on the second boss and having an outer cylindrical surface located in rotational surface engagement with the cylindrical wall of the first arm.

8. The tool of claim 1 wherein: each of the ramp surfaces is inclined inwardly at an angle between about 2 to about 6 degrees relative to a chord plane of the body.

9. The tool of claim 1 wherein: each of the ramp surfaces is inclined inwardly at an angle of about 3 degrees relative to a chord plane of the body.

10. The tool of claim 1 including: a push button joined to the stem, said biasing means comprising a coil spring engaging the body and push button is operable to bias the stem to its first position wherein the ball is in the socket lock position.

11. The tool of claim 1 wherein: the one of said arms has radial bores open to the body, said brake including brake pads located in said bores engageable with the body, biasing means located in the bores for applying a biasing force on the brake pads to retain the brake pads in continuous engagement with the body, and plugs located in the bores engageable with the biasing means to retain the biasing means and brake pads in the bores.

12. The tool of claim including: a helical band located within the chamber providing a generally helical path for air flowing in the chamber, and means connecting the band to the air motor housing.

13. The tool of claim 1 including: a generally cylindrical screen located within the chamber, and means retaining the screen in engagement with said collar.

* * * * *